US010064456B2

(12) United States Patent
Tang et al.

(10) Patent No.: US 10,064,456 B2
(45) Date of Patent: Sep. 4, 2018

(54) ZIP SLIDER STRUCTURE

(71) Applicant: CHUNG CHWAN ENTERPRISE CO., LTD., Taoyuan (TW)

(72) Inventors: Ge-Chian Tang, Taoyuan (TW); Yu-Pau Lin, Taoyuan (TW)

(73) Assignee: CHUNG CHWAN ENTERPRISE CO., LTD., Taoyuan (TW)

( * ) Notice: Subject to any disclaimer, the term of this patent is extended or adjusted under 35 U.S.C. 154(b) by 0 days.

(21) Appl. No.: 15/814,198

(22) Filed: Nov. 15, 2017

(65) Prior Publication Data

US 2018/0070685 A1 Mar. 15, 2018

Related U.S. Application Data

(63) Continuation-in-part of application No. 15/073,577, filed on Mar. 17, 2016, now Pat. No. 9,901,146.

(30) Foreign Application Priority Data

Jul. 3, 2015 (TW) ..... 104210782 U

(51) Int. Cl.
*A44B 19/30* (2006.01)
*B21D 53/52* (2006.01)

(52) U.S. Cl.
CPC ..... *A44B 19/303* (2013.01); *B21D 53/52* (2013.01)

(58) Field of Classification Search
CPC ... A44B 19/262; A44B 19/306; A44B 19/308; A44B 19/303; B21D 53/52
See application file for complete search history.

(56) References Cited

U.S. PATENT DOCUMENTS 4,081,883 A * 4/1978 Ishii ..... A44B 19/306 24/421
4,139,928 A * 2/1979 Aoki ..... A44B 19/26 24/424
4,271,567 A * 6/1981 Aoki ..... A44B 19/306 24/421
4,287,646 A * 9/1981 Kanzaka ..... A44B 19/308 24/424
4,768,263 A * 9/1988 Fukuroi ..... A44B 19/306 24/418
5,896,628 A * 4/1999 Oda ..... A44B 19/306 24/421

(Continued)

*Primary Examiner* — David M Upchurch
(74) *Attorney, Agent, or Firm* — Li & Cai Intellectual Property (USA) Office

(57) ABSTRACT

The instant disclosure provides a zip slider structure including a slider body, a tab-holder and a pull-tab arranged between the tab-holder and the slider body. The slider body includes a first slide portion, a second slide portion and a connecting portion including a joint recess. The first slide portion includes a first slide surface, an arranging surface, a first recess, a second recess and a first extension end. The tab-holder includes a body portion, a first bending portion extending from one end of the body portion and passing the first recess, and a second bending portion extending from the other end of the body portion. The first bending portion includes a slot joining with the first extension end, the second bending portion includes a holding end joining with the joining recess, the body portion includes an attaching member extending from the body portion and joining with the second recess.

7 Claims, 11 Drawing Sheets

(56) References Cited

U.S. PATENT DOCUMENTS

| | | | | |
|---|---|---|---|---|
| 6,588,072 | B1 * | 7/2003 | Lin | A44B 19/265<br>24/416 |
| 6,637,078 | B2 * | 10/2003 | Nagata | A44B 19/306<br>24/419 |
| 6,769,156 | B1 * | 8/2004 | Chen | A44B 19/306<br>24/419 |
| 8,584,326 | B2 * | 11/2013 | Keyaki | A44B 19/306<br>24/420 |
| 8,782,857 | B2 * | 7/2014 | Keyaki | A44B 19/306<br>24/421 |
| 2005/0076480 | A1 * | 4/2005 | Chen | A44B 19/306<br>24/415 |
| 2011/0041297 | A1 * | 2/2011 | Iwase | A44B 19/306<br>24/418 |
| 2012/0291236 | A1 * | 11/2012 | Lin | A44B 19/26<br>24/429 |
| 2012/0297584 | A1 * | 11/2012 | Lin | A44B 19/306<br>24/429 |
| 2013/0174387 | A1 * | 7/2013 | Hamada | A44B 19/306<br>24/418 |

* cited by examiner

ZIP SLIDER STRUCTURE

CROSS-REFERENCE TO RELATED APPLICATION

This application is a continuation-in-part application of U.S. application Ser. No. 15/073,577 filed on Mar. 17, 2016, now pending. The entirety of the above-mentioned patent applications is hereby incorporated by reference herein and made as a part of this specification.

BACKGROUND

1. Technical Field

The instant disclosure relates to a zip slider structure, in particular, to a zip slider structure with the pull-tab positioned between the tab-holder and the slider body.

2. Description of Related Art

There are a plenty of types of zip slider structure in the market. However, the above zip slider structures have complicated structures and must be manufactured by a stamping process to engage the pull-tab with the slider body. In addition, as shown in the TW558966 patent, the structure has a sleeve 23 and a circle 21 arranged on a hook strip 31 for enabling the user to pull on it. However, the above structure is not able to secure the sleeve 23 and the circle 21 on the hook strip 31 to limit the positions of the sleeve 23 and the circle 21. Furthermore, in the zip slider structure, the slider body may be disengaged and the plurality of serrated structures arranged on two separate fabrics would separate from each other when the user moves or jumps.

SUMMARY

In view of the above problem, the embodiment of the instant disclosure provides a zip slider structure that may eliminate the complication of the arrangement of the zip slider structure and may further limit the slider body on the zip slider structure. In the meantime, by arranging a stopping end on the tab-holder, the zip slider structure would not disengage during the movement of the user (for example, the zip slider structure would not disengage when the user jumps).

In order to achieve the above purpose, an exemplary embodiment of the instant disclosure provides a zip slider structure comprising a slider body, a tab-holder and a pull-tab. The slider body comprises a first slide portion, a second slide portion arranged corresponding to the first slide portion, and a connecting portion connecting the first slide portion and the second slide portion, in which an accommodating space is positioned between the first slide portion and the second slide portion. The first slide portion has a first slide surface, an arranging surface, a first recess, a second recess, and a first extension end, the second slide portion has a second slide surface, the first slide surface faces the second slide surface, the arranging surface and the first slide surface are positioned on two opposite surfaces of the first slide portion respectively, and the connecting portion has a joining recess. The tab-holder comprises a body portion, a first bending portion extending from an end of the body portion and passing through the first recess, and a second bending portion extending from the other end of the body portion, in which the first bending portion has a slot joining and fixing with the first extension end, the second bending portion has a holding end joining and fixing with the joining recess, the body portion has an attaching member extending from the body portion and joining and fixing with the second recess. The attaching member has an extending body and a securing bump connecting to the extending body and extending from two sides of the extending body, the securing bump abuts the second recess. The pull-tab comprises a holding portion and a pivot portion, the pivot portion arranged between the tab-holder and the slider body.

The advantages of the instant disclosure reside in that by arranging the pivot portion of the pull-tab between the tab-holder and the slider body and arranging the stopping end on the tab-holder, it is able to avoid the zip slider structure from disengaging while the user moves or jumps. By attaching the slot of the tab-holder with the first extension end of the pull-tab, joining the attaching member of the tab-holder with the second extension end of the pull-tab and joining the holding end of the tab-holder and the joining recess of the pull-tab, the tab-holder and the pull-tab may be joined with each other.

A method of forming a zip slider structure is also provided in the present disclosure. The method of forming a zip slider structure includes forming a slider body by press punching, forming an elastic tab holder by press punching and placing a pull-tab on the slider body and assembling the elastic tab holder on the slider body for clamping the pull-tab. The slider body includes a first slide portion, a second slide portion arranged corresponding to the first slide portion, and a connecting portion connecting the first slide portion and the second slide portion, in which an accommodating space is positioned between the first slide portion and the second slide portion, the first slide portion has a first slide surface, an arranging surface, a first recess, a second recess and a first extension end, the second slide portion has a second slide surface, the first slide surface faces the second slide surface, the arranging surface and the first slide surface are positioned on two opposite surfaces of the first slide portion respectively, and the connecting portion has a joining recess. The elastic tab-holder comprises a body portion, a first bending portion extending from an end of the body portion and passing through the first recess, and a second bending portion extending from the other end of the body portion, wherein the first bending portion has a slot joining and fixing with the first extension end, the body portion has an attaching member extending from the body portion and joining and fixing with the second recess, the attaching member has an extension body without a through hole and a securing bump formed at an end of the extending body and extending from two sides of the extending body, and thus the attaching member is inverse-T-shaped, and the securing bump of the attaching member abuts against an inner surface of the second recess due to an elastic property of the tab-holder. The pull-tab comprises a holding portion and a pivot portion, the pivot portion is arranged between the tab-holder and the slider body. The attaching member is stamped and bent from the body portion of the tab-holder, so that the body portion of the tab-holder has an opening having a shape substantially the same as the shape of the attaching member.

Furthermore, the step of forming the elastic tab holder by press punching includes providing an elastic sheet, forming a first bending portion, wherein the first bending portion has a slot and a stopping end, and concurrently forming a body portion and a second bending portion. The body portion has an attaching member and an opening, and the second bending portion has a holding end and a connecting end.

Moreover, the step of forming the slider body by press punching includes, providing a sheet, press punching the sheet to form a first slide portion, a second slide portion and a connecting portion, bending the connecting portion to make the first slide portion and the second slide portion to be in a corresponding position. The first slide portion has a first recess, a second recess, a first extension end, a second extension end, an abut surface and a side surface.

In order to further understand the techniques, means and effects of the instant disclosure, the following detailed descriptions and appended drawings are hereby referred to, such that, and through which, the purposes, features and aspects of the instant disclosure can be thoroughly and concretely appreciated; however, the appended drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the instant disclosure.

DESCRIPTION OF THE EXEMPLARY EMBODIMENTS

Figure 1:
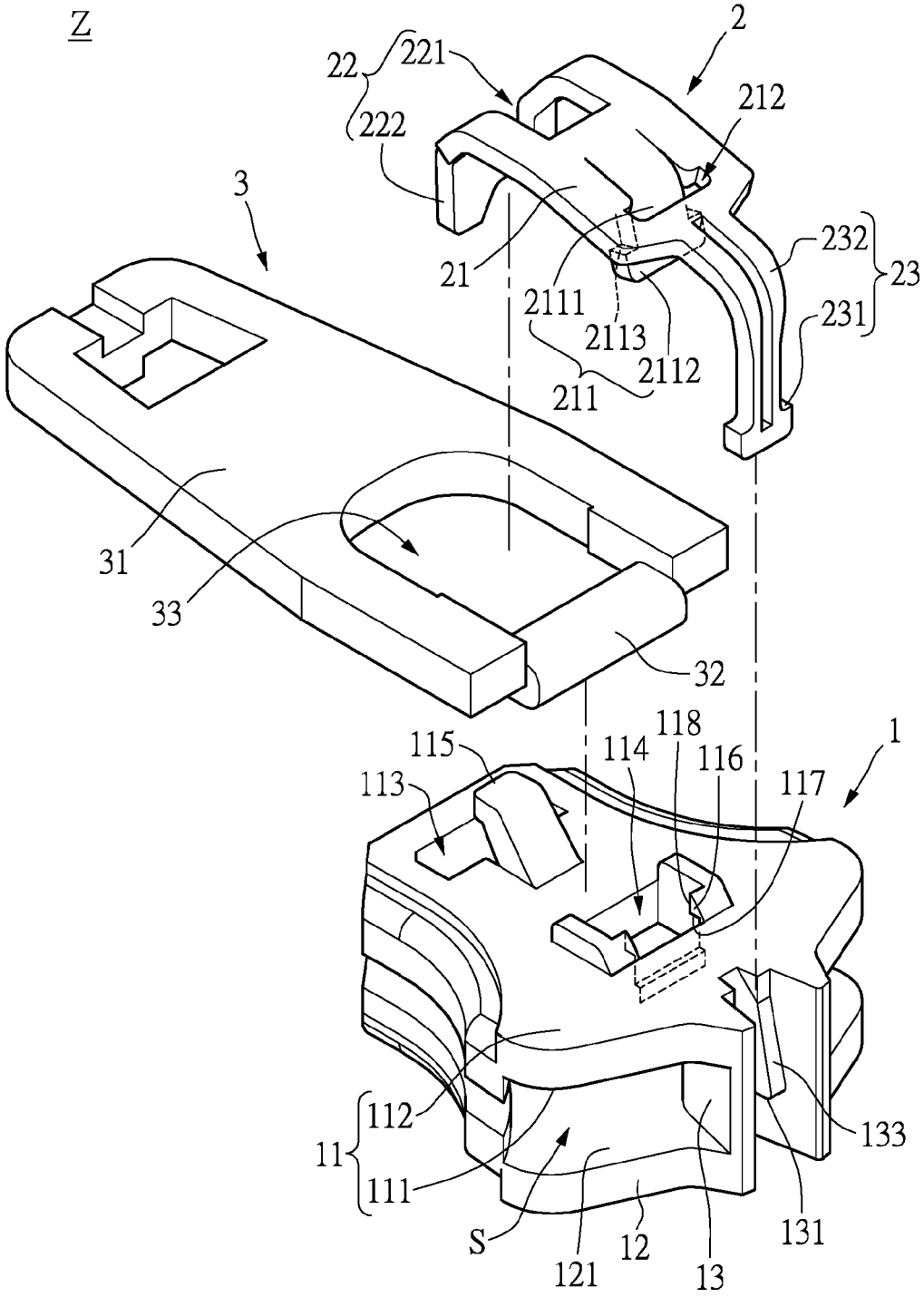
FIG. 1 is a 3-dimentional exploded view of a zip slider structure of an embodiment of the instant disclosure.
Figure 2:
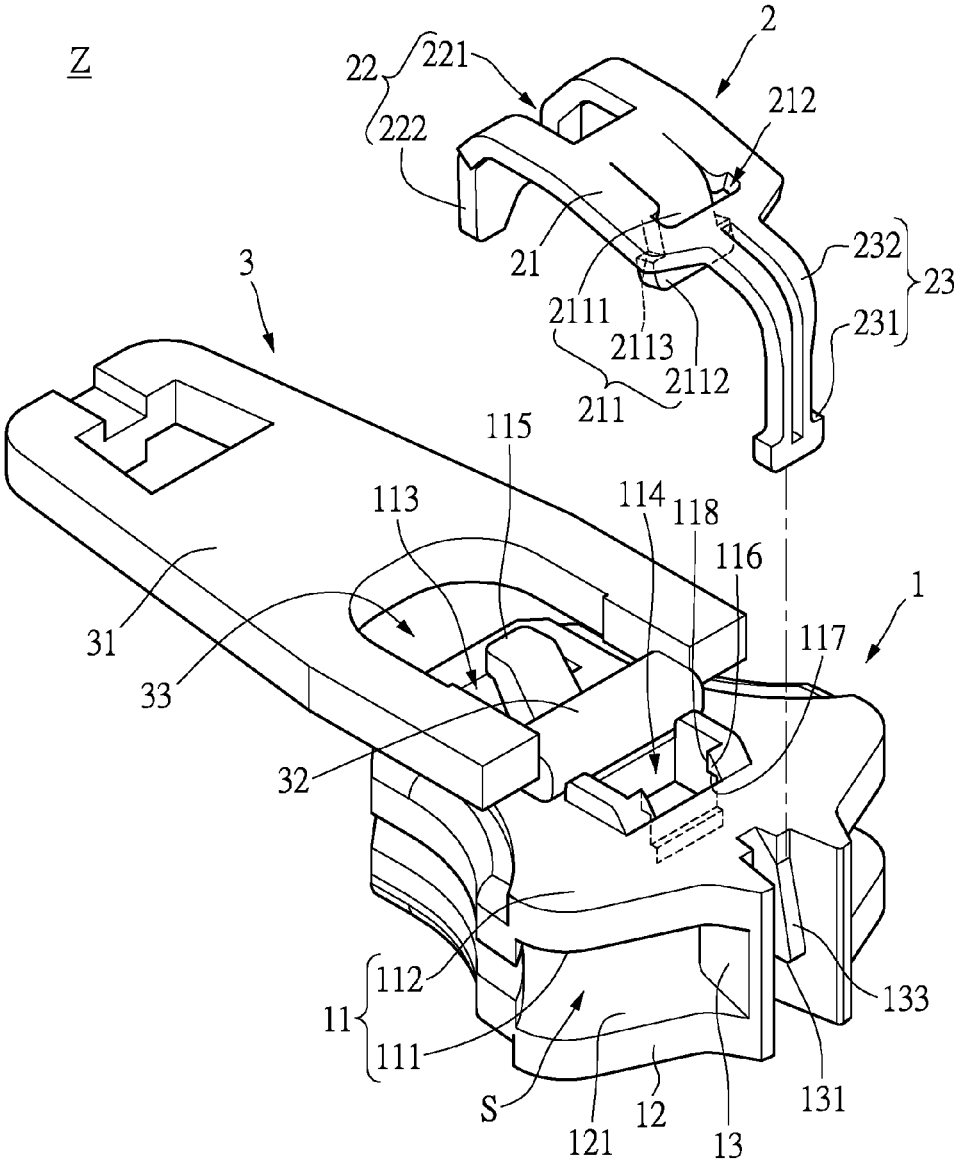
FIG. 2 is a 3-dimentional assembled view of the zip slider structure of the embodiment of the instant disclosure.
Figure 3:
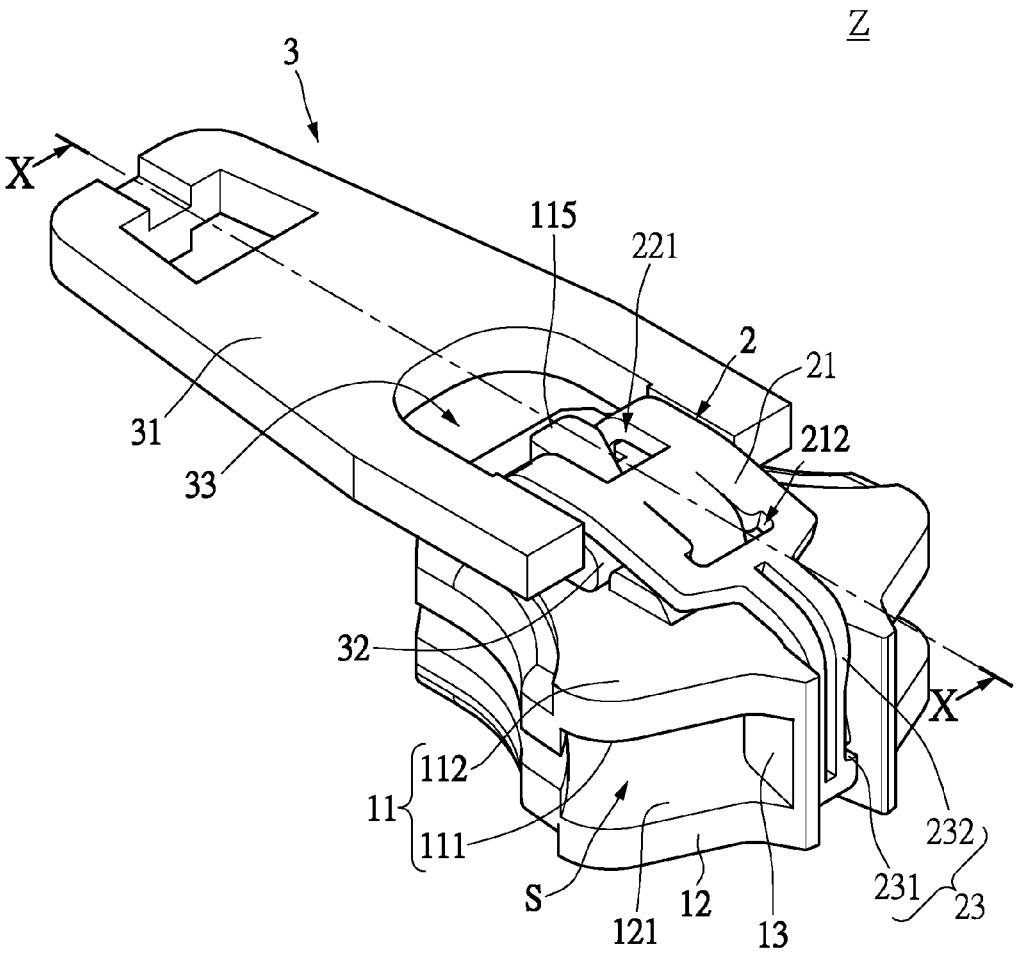
FIG. 3 is another 3-dimentional assembled view of the zip slider structure of the embodiment of the instant disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

First, please refer to FIG. 1 to FIG. 3, FIG. 6 and FIG. 7. The embodiment of the instant disclosure provides a zip slider structure Z comprising a slider body 1, an elastic tab-holder 2 and a pull-tab 3 that may be arranged between the tab holder 2 and the slider body 1. For example, the material of the elastic tab-holder 2 may be a spring sheet with elastic property or other elastic materials with elastic property and hence, the elastic property of the elastic tab-holder 2 may secure the elastic tab-holder 2 on the slider body 1 to fix the position of the pull-tab 3.

The slider body 1 has a first slide portion 11, a second slide portion 12 arranged corresponding to the first slide portion 11, and a connecting portion 13 connecting the first slide portion 11 and the second slide portion 12. An accommodating space 13 is positioned between the first slide portion 11 and the second slide portion 12. In the embodiment of the instant disclosure, the shape constituted by the first slide portion 11, the second slide portion 12, and the connecting portion 13 may be a structure with a side down-U shape ("ㄱ" shape).

Next, the first slide portion 11 has a first slide surface 111, an arranging surface 112, a first recess 113, a second recess 114, and a first extension end 115. The arranging surface 112 and the first slide surface 111 are positioned on the upper surface and the lower surface of the first slide portion 11 respectively. The first recess 113 and the second recess 114 pass through the first slide portion 11 respectively to connect the first slider surface 111 and the arranging surface 112. For example, the first extension end 115 may be arranged between the first recess 113 and the second recess 114, and the first extension end 115 extends to above the first recess 113. However, the instant disclosure is not limited thereto. The second slide portion 12 may have a second slide surface 121, the first slide surface 111 faces the second slide surface 121 so that the first slide surface 111 and the second slide surface 121 face each other, thereby enabling a plurality of serrated structures (not shown) slide in the accommodating space S formed between the first slide surface 111 and the second slide surface 121.

Figure 6:
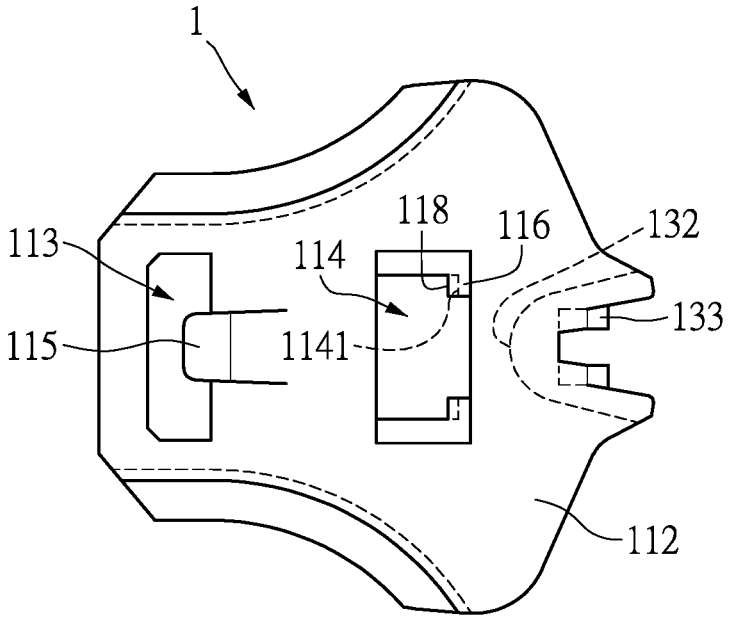
FIG. 6 is a top schematic view of the slider body of the zip slider structure of the embodiment of the instant disclosure.
Figure 7:
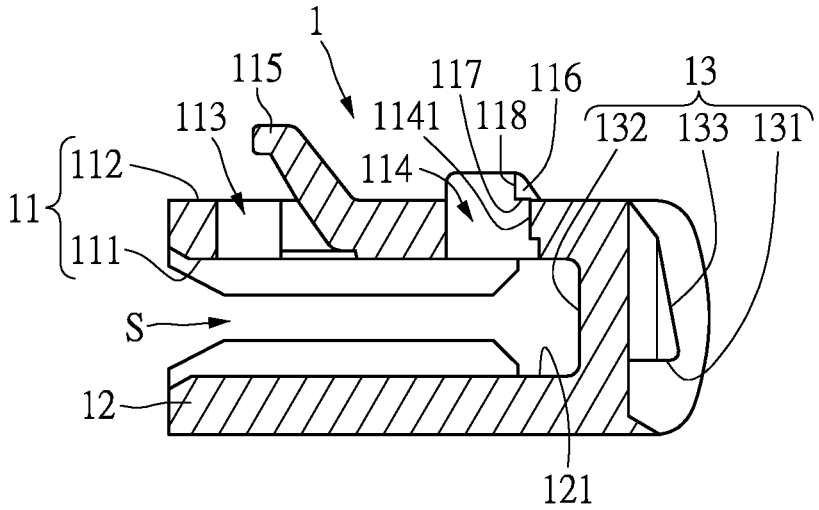
FIG. 7 is a sectional schematic view of the slider body of the zip slider structure of the embodiment of the instant disclosure.

The first slide portion 11 further comprises a second extension end 116 that may be arranged on the arranging surface 112, and the second extension end 116 is extended from the second recess 114. For example, the second extension end 116 may be arranged on two sides of the second recess 114 for arranging the elastic tab-holder 2. It is worthwhile to mention that as shown in FIG. 6, the second recess 114 and the second extension end 116 may form a through hole with a convex shape. In addition, the connecting portion 13 has a joining recess 131 and a top surface 132. In the embodiment of the instant disclosure, the joining recess 131 and the top surface 132 are positioned at two opposite ends of the connecting portion 13, the top surface 132 may be positioned in the accommodating space S, and the joining recess 131 may be positioned on the other side surface of the top surface 132.

Figure 4:
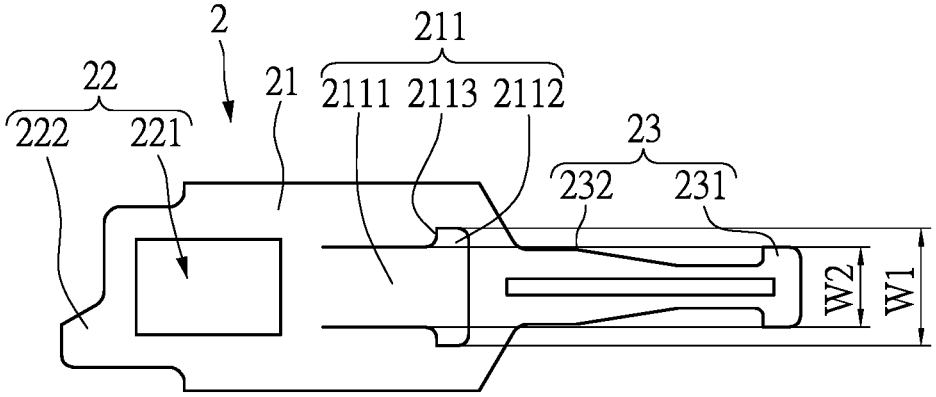
FIG. 4 is a top schematic view of a tab-holder of the zip slider structure of the embodiment of the instant disclosure before bending.
Figure 5:
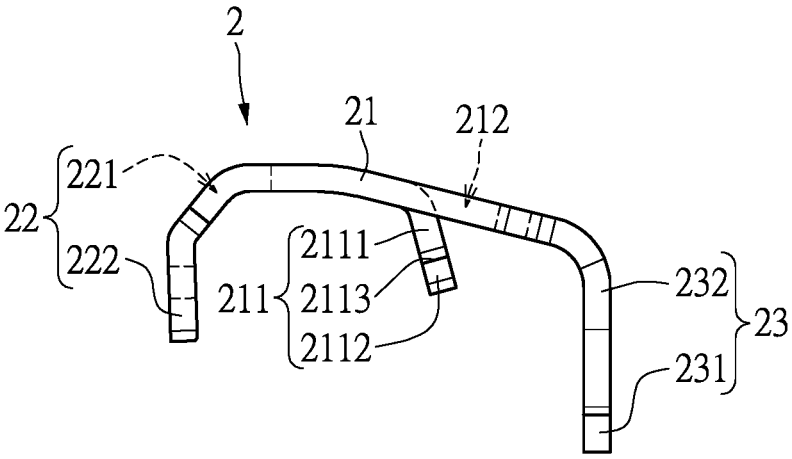
FIG. 5 is a side schematic view of a tab-holder of the zip slider structure of the embodiment of the instant disclosure after bending.

Please refer to FIG. 4 and FIG. 5. The elastic tab-holder 2 has a body portion 21, a first bending portion 22 extending from an end of the body portion 21 and passing through the first recess 133, and a second bending portion 23 extending from the other end of the body portion 21. For example, in the embodiment of the instant disclosure, the first bending portion 22, the body portion 21 and the second bending portion 23 may form a structure with a side down-U shape ("コ" shape), and the elastic tab-holder 2 is connected with the slider body 1 through the first bending portion 22 and the second bending portion 23.

To be specific, the first bending portion 22 has a slot 221 joining and fixing with the first extension end 115 and a stopping end 222 for avoiding the zip slider structure Z from disengaging. The slot 221 is arranged between the stopping end 222 and the body portion 21, and the second bending portion 23 has a holding end 231 joining and fixing with the joining recess 131. The body portion 21 has an attaching member 211 extending from the body portion 21 and joining and fixing with the second recess 114 on the slider body 1. In addition, it is worthwhile to mention that the attaching member 211 on the body portion 21 may be directly formed by a stamping process. Therefore, an opening 212 having the same shape as the attaching member 211 may be formed on the body portion 21. In other words, the attaching member 211 and the opening 212 have a convex shape. Specifically, the attaching member 211 has an extension body 2111 and a securing bump 2112 connecting to the end of the extension body 2111 and extending from the two sides of the extension body 2111, and the securing bump 2112 may abut the second recess 114. Therefore, abutting the securing bump 2112 on the second recess 114 and the second extension end 116, serves to avoid the elastic tab-holder 2 separating from the slider body 1. It is worthwhile to mention that in order to increase the rigidity of the attaching member 211 and the securing force between the slider body 1 and the elastic tab-holder 2, the attaching member 211 does not have any through holes or a recess thereon. In addition, the width W1 of the securing bump 2112 is larger than the width W2 of the extension body 2111 to increase the contact area between the securing bump 2112 having larger width and the abut surface 117 and the inner surface 1141. Therefore, the stress applied by the attaching member 211 on the abut surface 117 and the inner surface 1141 would be evenly distributed, and the engaging force applied by the attaching member 211 on the abut surface 117 and the inner surface 1141 may be increased at the same time.

Figure 8:
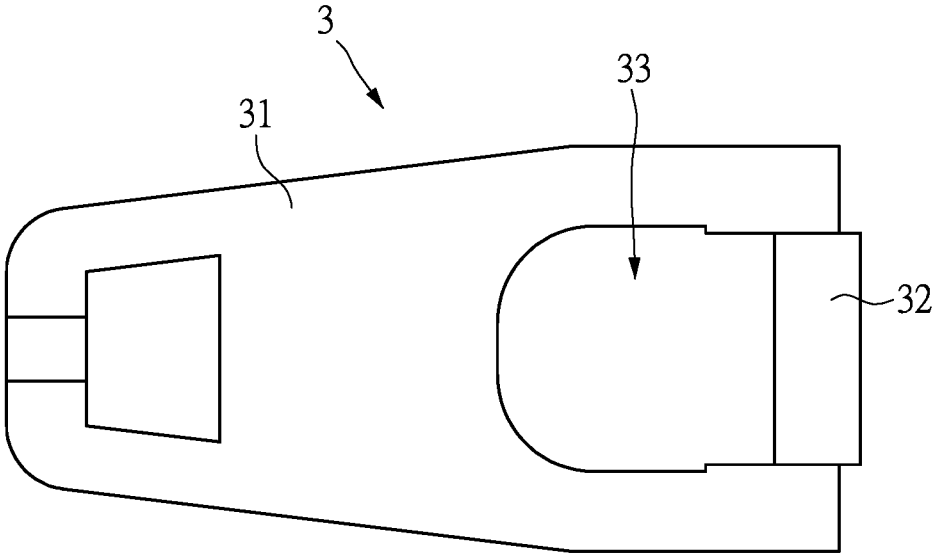
FIG. 8 is a top schematic view of the pull-tab of the zip slider structure of the embodiment of the instant disclosure.
Figure 9:
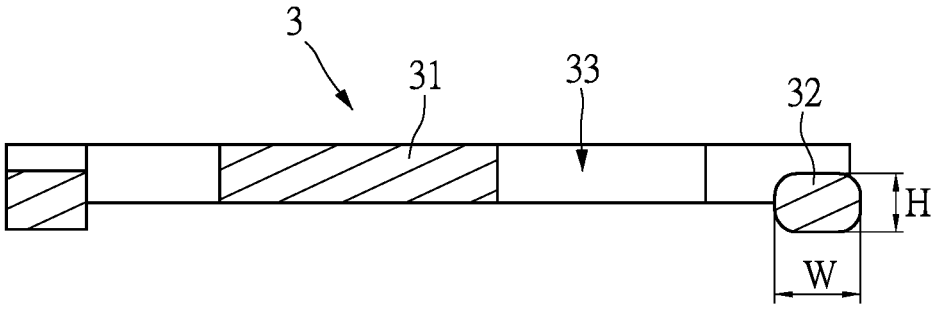
FIG. 9 is a sectional schematic view of the pull-tab of the zip slider structure of the embodiment of the instant disclosure.

Please refer to FIG. 8 and FIG. 9 at the same time. The pull-tab 3 has a holding portion 31, a pivot portion 32 and a recess portion 33. The recess portion 33 may be positioned between the holding portion 31 and the pivot portion 32, and by passing the first bending portion 22 through the recess 33, the pivot portion 32 is arranged between the elastic tab-holder 2 and the slider body 1. To be specific, the pivot portion 32 may be arranged between the first bending portion 22 and the attaching member 211 of the elastic tab-holder 2, thereby enabling the pivot portion 32 to pivot between the elastic tab-holder 2 and the pull-tab 1.

Next, please refer to FIG. 1 to FIG. 3 and FIG. 10 at the same time. The securing bump 2112 has an attaching surface 2113 extending from two sides, the second extension end 116 has an abut surface 117 and a side surface 118, and the side surface 118 connects to the abut surface 117. In the embodiment of the instant disclosure, the attaching member 211 is in reverse-T shape (convex shape). However, the instant disclosure is not limited thereto. In addition, the second recess 114 has an inner surface 1141 therein, the inner surface 1141 of the second recess 114 may connect the abut surface 117, and hence, the inner surface 1141, the abut surface 117 and the side surface 118 may connect with each other sequentially.

After arranging the pivot portion 32 of the pull-tab 3 between the first extension end 115 and the second extension end 116 of the slider body 1, the stopping end 222 of the elastic tab-holder 2 may be inserted into the first recess 113. Afterward, the first extension end 115 may be arranged in the slot 221, then pressing the attaching member 211 and the holding end 231 into the second recess 114 and the joining recess 313 respectively, thereby securing the elastic tab-holder 2 and the slider body 1.

It is worthwhile to mention that since the elastic tab-holder 2 is made from a material with elastic property and the distance between the inner surface 1141 of the second recess 114 and the top surface 132 of the connecting portion 13 is smaller than the distance between the side surface 118 of the second extension end 116 and the top surface 132, when the attaching member 211 and the holding end 231 are pressed into the second recess 114 and the joining recess 131 respectively, the attaching member 211, first being abutted by the side surface 118 of the second extension end 116, bends, and when the securing bump 2112 of the attaching member 211 slides apart from the side surface 118 to the second recess 114, the attaching member 211, no longer being abutted by the side surface 118, goes backward, and hence, the attaching surface 2113 of the securing bump 2112 of the attaching member 211 abuts the abut surface 117 of the second extension end 116. In other words, the securing bump 2112 of the attaching member 211 may abut the abut surface 117 of the second extension end 116 and the inner surface 1141 of the second recess 114 at the same time. In addition, the holding end 231 of the second bending portion 23 may first slide along the inclined surface 133 of the connecting portion 31, and the second bending portion 23 will move outwardly based on the elastic property of the material until the holding end 231 slides into the joining recess 131. Thereby, by abutting the attaching member 211 and the holding end 231 on the elastic tab-holder 2 on the second recess 114 and the joining recess 131 respectively, the tab-holder may be positioned on the slider body 1.

In other words, the instant disclosure utilizes the attachment of the slot 221 and the first extension end 115, the engagement of the attaching member 211 and the second extension end 116, and the engagement of the holding end 231 and the joining recess 131 to secure the elastic tab-holder 2 on the slider body 1.

Figure 10:
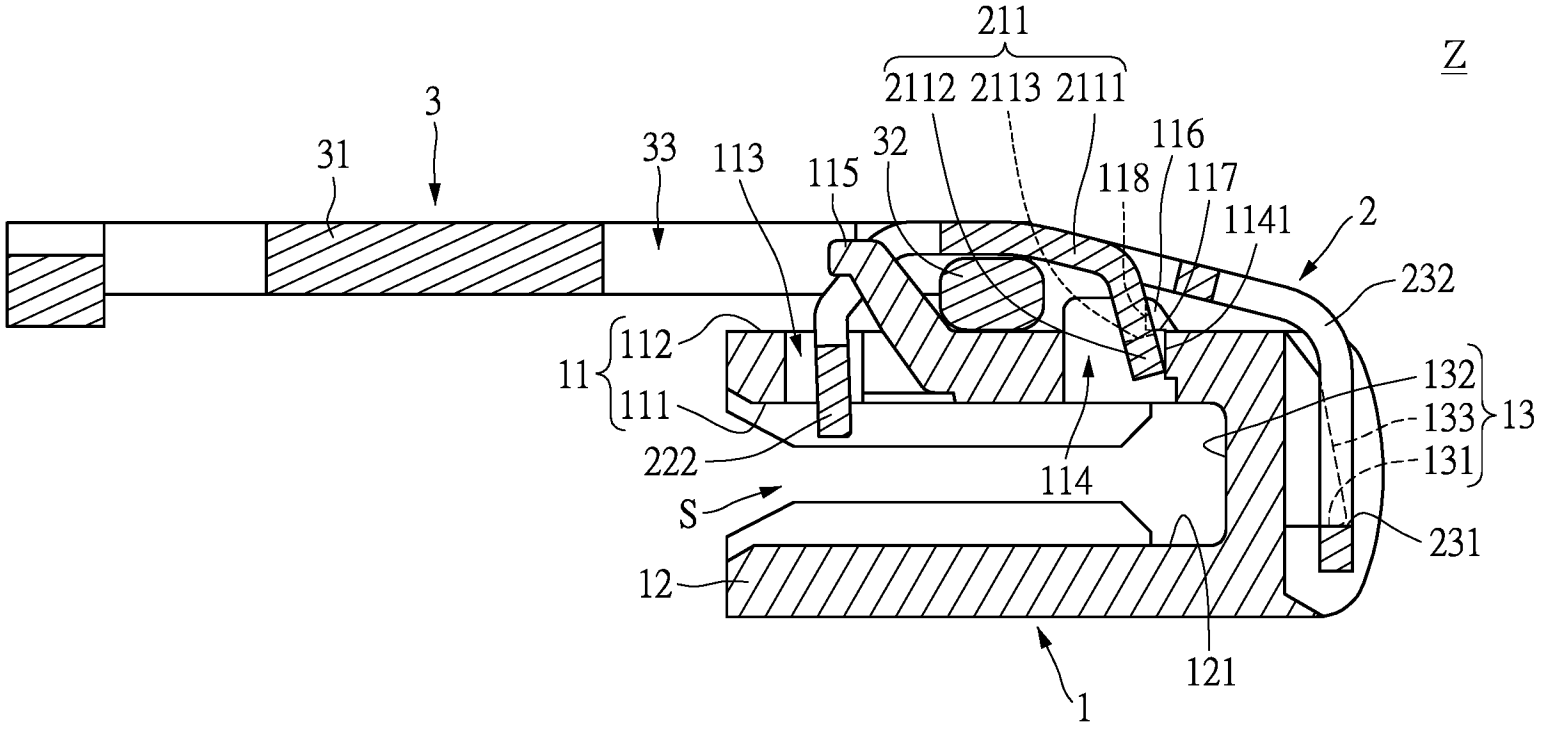
FIG. 10 is a sectional schematic view taken along the X-X sectional line in FIG. 3.
Figure 11:
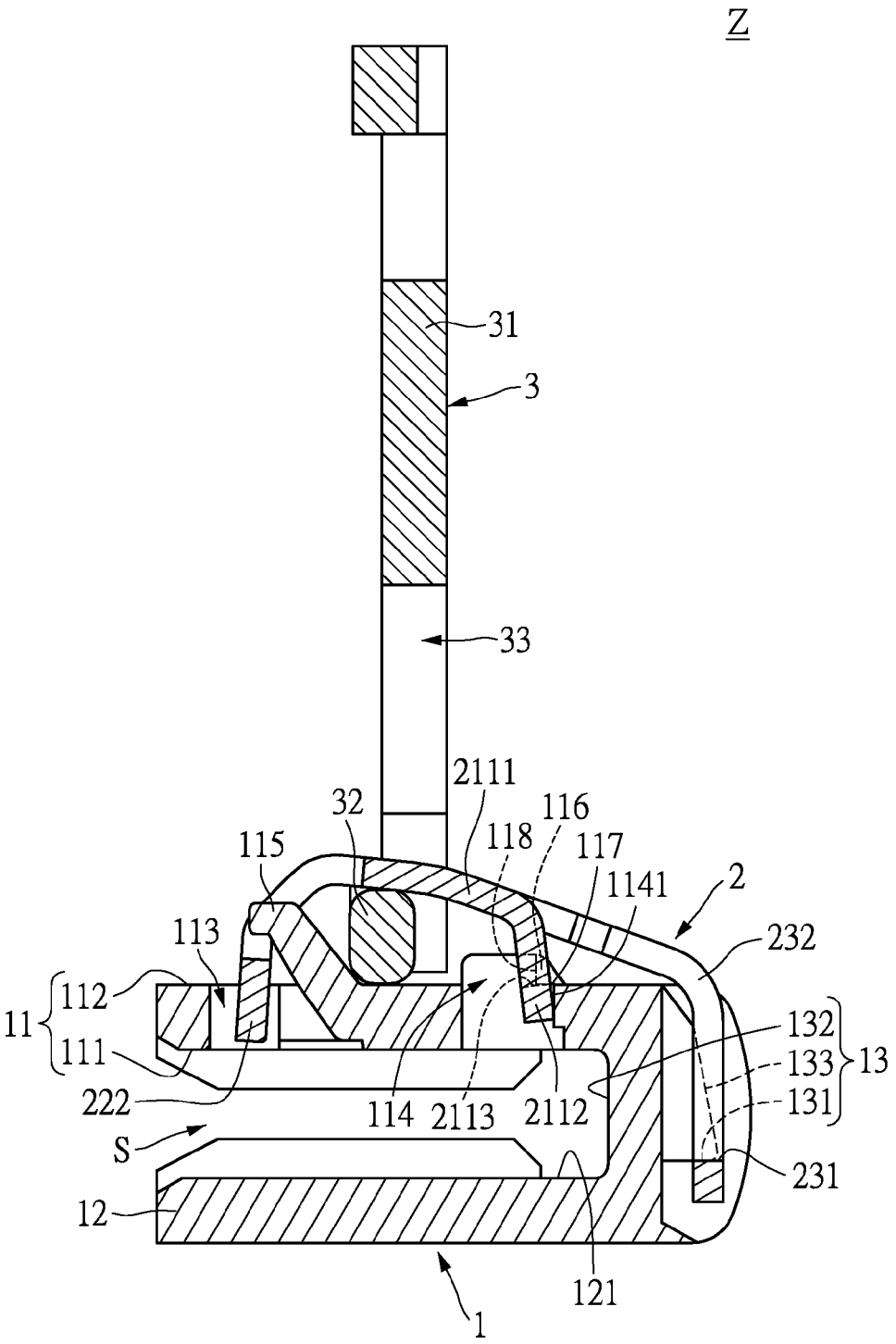
FIG. 11 is a sectional schematic view of the zip slider structure of the embodiment of the instant disclosure in use.

Please refer to FIGS. 9 to 11. As mentioned above, the two surfaces vertical to each other on the pivot portion 32 of the pull-tab 3 have a predetermined width W and a predetermined height H, in which the predetermined width W is larger than the predetermined height H. In other words, in the embodiment of the instant disclosure, the pivot portion 32 may be a structure with a rectangular shape. However, the instant disclosure is not limited thereto. As shown in FIG. 10, when the surface having the predetermined width W is parallel to the first slide surface 111, the stopping end 222 of the elastic tab-holder 2 will project from the first recess 113 and position in the accommodating space S, and hence, the stopping end 222 will be stuck between two adjacent serrate structures (not shown), thereby avoiding the zip slider structure Z from disengaging from the plurality of serrate structures. Next, as shown in FIG. 11, since the predetermined width W is larger than the predetermined height H, when the surface having the predetermined height H is parallel to the first slide surface 111, the elastic tab-holder 2 would be jacked up by the pivot portion 32 of the pull-tab 3 and hence, the elastic tab-holder 2 displaces and the stopping end 222 of the elastic tab-holder 2 will be received in the first recess 113 and does not extend into the accommodating space S. Therefore, the stopping end 222 may disengage from two adjacent serrate structures (not shown), and the zip slider structure Z may slide on the plurality of serrate structures to control the hinge or disengagement of the serrate structure.

[Effects Achieved by the Embodiment]

In sum, the zip slider structure Z provided by the instant disclosure arranges the pivot portion 32 of the pull-tab 3 between the elastic tab-holder 2 and the slider body 1 for the user to pull on, and the zip slider structure Z is constituted by the slider body 1, the elastic tab-holder 2 and the pull-tab 3 and hence, is easy to assemble. In addition, by utilizing the attachment between the slot 221 of the elastic tab-holder 2 and the first extension end 115 of the slider body 1, the engagement between the attaching member 211 of the elastic tab-holder 2 and the second extension end 116 of the slider body 1, and the engagement between the holding end 231 of the elastic tab-holder 2 and the joining recess 131 of the slider body, the elastic tab-holder 2 and the slider body 1 are able to engage with each other. Furthermore, based on the elastic property of the material of the elastic tab-holder 2 in conjunction with the pull-tab 3 having the pivot portion 32 with a rectangular shape, the pull-tab 3 may be limited in a predetermined position such as a horizontal position as shown in FIG. 10, or a vertical position as shown in FIG. 11. Moreover, the stopping end 222 arranged on the elastic tab-holder 2 may avoid the zip slider structure Z from disengaging during the movement or jumping of the user.

A method of forming a zip slider structure is also provided in the present disclosure. The method of forming a zip slider structure includes forming a slider body by press punching, forming an elastic tab holder by press punching, and placing a pull-tab on the slider body and assembling the elastic tab holder on the slider body for clamping the pull-tab. As addressed above and shown in such as FIG. 1 or FIG. 2, the zip slider structure Z includes a slider body 1, an elastic tab-holder 2 and a pull-tab 3 that may be arranged between the tab holder 2 and the slider body 1.

Figure 12:
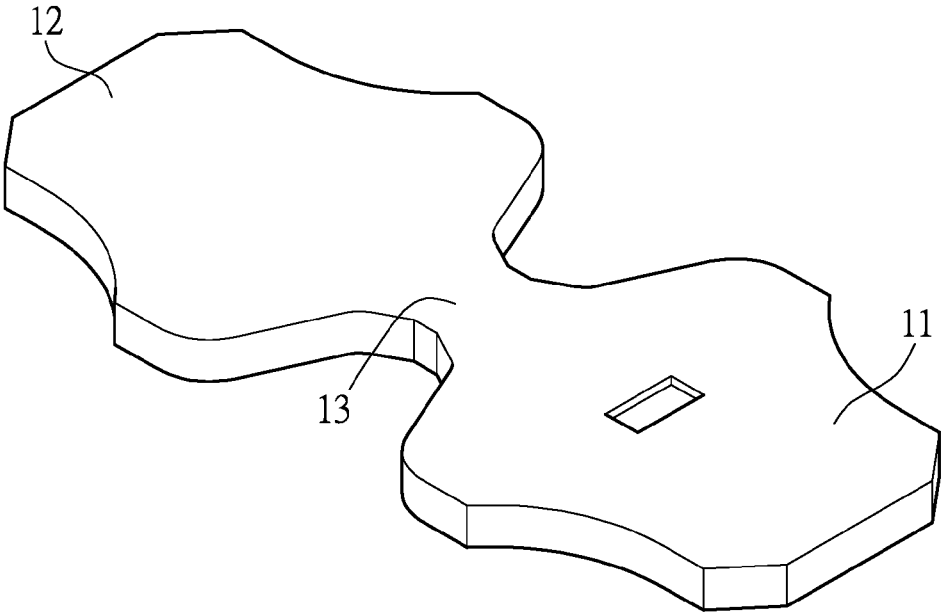
FIG. 12 is a schematic view illustrating how the slider body is formed.
Figure 13:
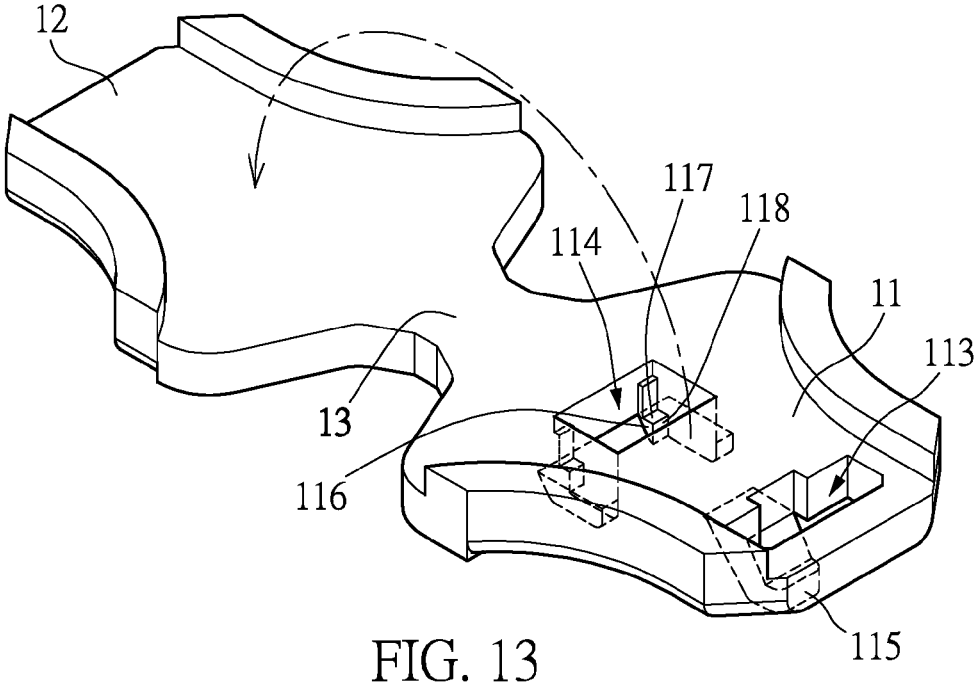
FIG. 13 is a schematic view illustrating how the slider body is formed.
Figure 14:
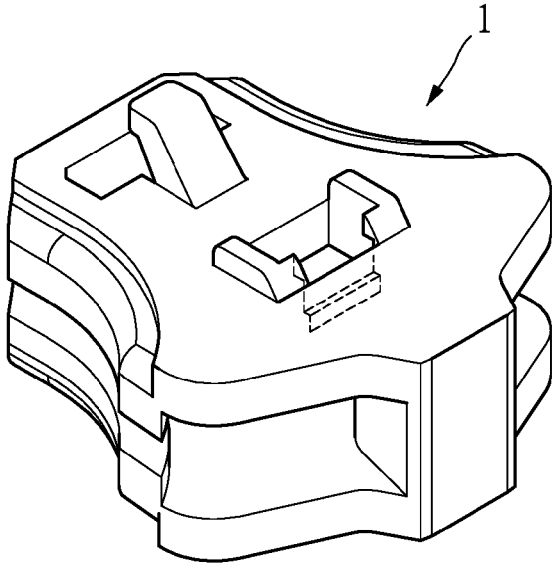
FIG. 14 is a schematic view illustrating how the slider body is formed.

The method for forming a zip slider structure will be described in more detail in the followings. References are made to FIGS. 12-14, where FIGS. 12-14 are schematic view illustrating how the slider body 1 is formed. In FIG. 12, a sheet is firstly provided. Next, a first slide portion 11, a second slide portion 12 and a connecting portion 13 are formed by press punching the sheet. It should be noted that the material of the sheet is not limited. The sheet can be, such as a metal sheet. One with ordinary skill in the art can choose different materials to meet different practical demands. References are next made to FIGS. 1 and 13, the first slide portion 11 is then formed with a first recess 113, a second recess 114, a first extension end 115, a second extension end 116, an abut surface 117 and a side surface 118. Further in FIG. 13, the connecting portion 113 is bent to make the first slide portion 11 and the second slide portion 12 to be in a corresponding position. The outcome can be seen in FIG. 14, in which the slider body 1 is formed.

Figure 15:
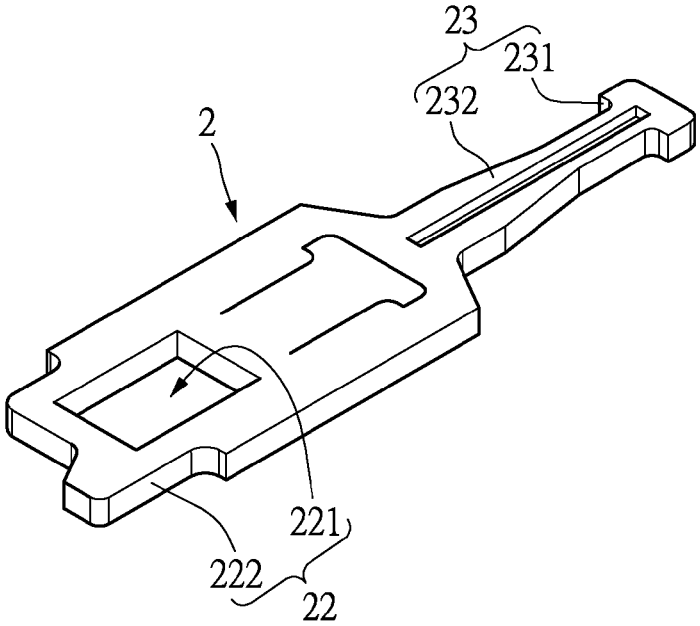
FIG. 15 is a schematic view illustrating how the elastic tab holder is formed.
Figure 16:
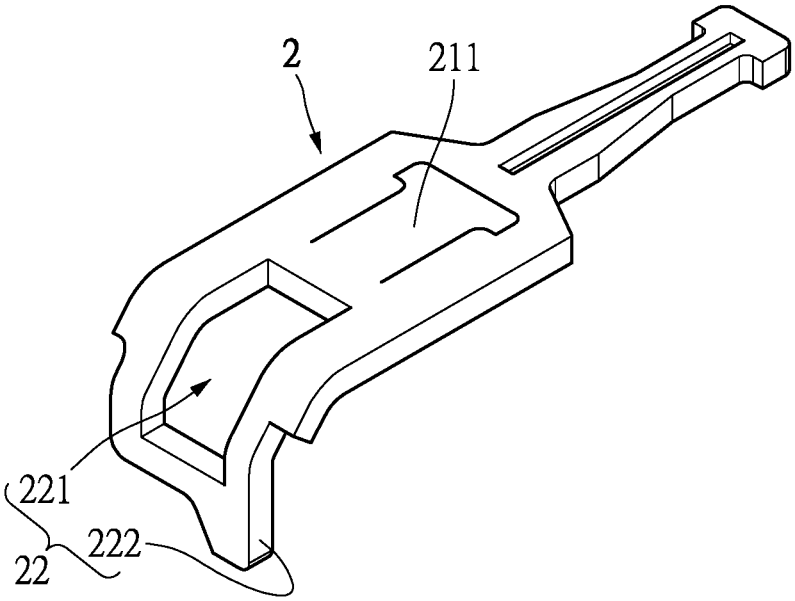
FIG. 16 is a schematic view illustrating how the elastic tab holder is formed.
Figure 17:
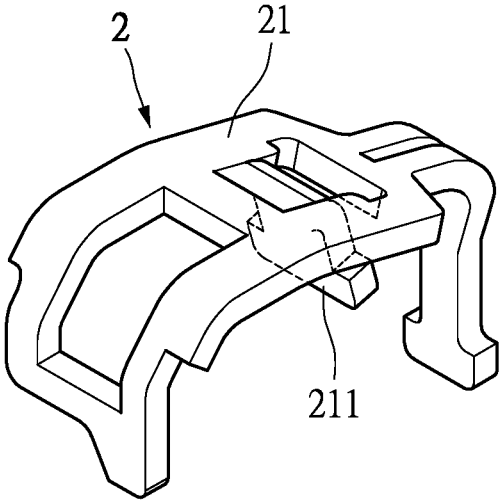
FIG. 17 is a schematic view illustrating how the elastic tab holder is formed.

Reference is next made to FIGS. 15-17, where FIGS. 15-17 are schematic views illustrating how the elastic tab holder 2 is formed. In FIG. 15, an elastic sheet is firstly provided, and the elastic sheet is formed with a first bending portion 22 having a slot 221 and a stopping end 222. It should be noted that the material of the elastic sheet is not limited. The elastic sheet can be, such as a metal sheet. One with ordinary skill in the art can choose different materials to meet different practical demands.

Next, a body portion 21 and a second bending portion 23 are concurrently formed. The body portion 21 has an attaching member 211 and an opening 212, and the second bending portion 23 has a holding end 231 and a connecting end 232. As shown in FIG. 16, the elastic sheet is bent to form the first bending portion 22, and as shown in FIG. 17, the elastic sheet is bent to form the second bending portion 23. The forming of the first bending portion 22 and the second bending portion 23 is not limited in order, the portions 22 and 23 and be formed one after the other, or can be formed concurrently. Moreover, in the present embodiment, the slot 221 is formed by press punching. One with ordinary skill in the art would understand that the forming of the slot should not be limited to certain kind of press punching only, any kind of press punching that can form the slot can be applied in the present disclosure.

In FIGS. 15 and 16, the opening 212 having substantially the same shape as the attaching member 211 is formed on the body portion 21. Reference is next made to FIGS. 16-17. By pushing down the attaching member 211 as shown in FIG. 16, the attaching member 211 as shown in FIG. 17 is thus formed. The attaching member 211 can be formed, for example, by cutting out the shape on the body portion 21 first, and then pushed or punched down from the body portion 21 to for the attaching member 211 as shown in FIG. 17. The outcome can be seen in FIG. 17, in which the elastic tab holder 2 is formed.

The slider body 1 and the elastic tab holder 2 as formed by the above addressed method will be integrated with the pull-tab 3 to form the zip slider structure Z, as shown in FIG. 1.

The above-mentioned descriptions represent merely the exemplary embodiment of the instant disclosure, without any intention to limit the scope of the instant disclosure thereto. Various equivalent changes, alterations or modifications based on the claims of instant disclosure are all consequently viewed as being embraced by the scope of the instant disclosure.

What is claimed is:

1. A method of forming a zip slider structure, comprising:

forming a slider body by press punching;

forming an elastic tab holder by press punching; and placing a pull-tab on the slider body and assembling the elastic tab holder on the slider body for clamping the pull-tab;

wherein the slider body comprises a first slide portion, a second slide portion arranged corresponding to the first slide portion, and a connecting portion connecting the first slide portion and the second slide portion, wherein an accommodating space is positioned between the first slide portion and the second slide portion, the first slide portion has a first slide surface, an arranging surface, a first recess, a second recess and a first extension end, the second slide portion has a second slide surface, the first slide surface faces the second slide surface, the arranging surface and the first slide surface are positioned on two opposite surfaces of the first slide portion respectively, and the connecting portion has a joining recess;

wherein the elastic tab-holder comprises a body portion, a first bending portion extending from an end of the body portion and passing through the first recess, and a second bending portion extending from the other end of the body portion, wherein the first bending portion has a slot joining and fixing with the first extension end, the body portion has an attaching member extending from the body portion and joining and fixing with the second recess, the attaching member has an extension body without a through hole and a securing bump formed at an end of the extending body and extending from two sides of the extending body, and thus the attaching member is inverse-T-shaped, and the securing bump of the attaching member abuts against an inner surface of the second recess due to an elastic property of the tab-holder;

wherein the pull-tab comprises a holding portion and a pivot portion, the pivot portion is arranged between the tab-holder and the slider body;

wherein the attaching member is stamped and bent from the body portion of the tab-holder, so that the body portion of the tab-holder has an opening having a shape substantially the same as the shape of the attaching member.

2. The method of claim 1, wherein the step of forming the elastic tab holder by press punching includes:

providing an elastic sheet;

forming a first bending portion, wherein the first bending portion has a slot and a stopping end; and concurrently forming a body portion and a second bending portion;

wherein the body portion has an attaching member and an opening, and the second bending portion has a holding end and a connecting end.

3. The method of claim 1, wherein the step of forming the slider body by press punching includes:

providing a sheet;

press punching the sheet to form a first slide portion, a second slide portion and a connecting portion;

bending the connecting portion to make the first slide portion and the second slide portion to be in a corresponding position;

wherein the first slide portion has a first recess, a second recess, a first extension end, a second extension end, an abut surface and a side surface.

4. The method of claim 1, wherein the securing bump has an attaching surface extending from two sides thereof, the second extension end has an abut surface, and the attaching surface abuts the abut surface.

5. The method of claim 4, wherein the securing bump abuts the abut surface and an inner surface of the second recess, and the inner surface connects to the abut surface.

6. The method of claim 5, wherein the second extension end further comprises a side surface connecting to the abut surface, the connecting portion further comprises a top surface, and a distance between the inner surface and the top surface is smaller than a distance between the side surface and the top surface.

7. The method of claim 1, wherein the first bending portion further comprises a stopping end, the slot is arranged between the stopping end and the body portion.

* * * * *